US006640871B2

(12) United States Patent
Cohen-Ravid et al.

(10) Patent No.: US 6,640,871 B2
(45) Date of Patent: Nov. 4, 2003

(54) SECURITY BARRIER ENDLESS DRIVE LOOP LOCK

(76) Inventors: Moshe Cohen-Ravid, 25 Hadekel Street, Tel-Mond (IL), 40600; John Alexander Lane, 308-8495 Ontario Street, Vancouver, British Columbia (CA), V5X 3E8

( * ) Notice: Subject to any disclaimer, the term of this patent is extended or adjusted under 35 U.S.C. 154(b) by 0 days.

(21) Appl. No.: 09/964,854

(22) Filed: Sep. 28, 2001

(65) Prior Publication Data

US 2002/0036068 A1 Mar. 28, 2002

Related U.S. Application Data

(60) Provisional application No. 60/235,911, filed on Sep. 28, 2000.

(51) Int. Cl.[7] ..... E04F 10/08

(52) U.S. Cl. ..... 160/188; 160/32

(58) Field of Search ..... 160/32, 33, 35, 160/36, 37, 133, 188, 189, 201, 265, 321, 322

(56) References Cited

U.S. PATENT DOCUMENTS

| | | | | |
|---|---|---|---|---|
| 343,956 A | | 6/1886 | Holmes | |
| 813,631 A | | 2/1906 | Elmquist | |
| 1,597,392 A | | 8/1926 | Rorabeck | |
| 2,057,850 A | | 10/1936 | Sims | 189/60 |
| 2,095,690 A | | 10/1937 | Brunst | 186/56 |
| 2,335,336 A | * | 11/1943 | Zoller | 160/189 |
| 2,423,987 A | | 7/1947 | Levikow | 160/35 |
| 2,672,192 A | | 3/1954 | Golner | 160/32 |
| 2,882,045 A | | 4/1959 | Moore | 268/59 |
| 3,103,246 A | | 9/1963 | Brodsky | 160/188 |
| 3,289,350 A | | 12/1966 | Moody | 49/28 |
| 3,389,740 A | | 6/1968 | Buehler | 160/188 |
| 3,436,862 A | * | 4/1969 | Stansbaerry | 160/189 |
| 3,601,175 A | | 8/1971 | Wardlaw | 160/133 |
| 3,738,413 A | | 6/1973 | Frobosilo et al. | 160/35 |
| 3,739,832 A | | 6/1973 | Sivin | 160/133 |

(List continued on next page.)

FOREIGN PATENT DOCUMENTS

| | | | |
|---|---|---|---|
| CH | 258795 | 12/1948 | |
| DE | 866843 | 2/1953 | |
| EA | 001858 | 8/2001 | |
| EP | 0 248 837 | 9/1989 | E06B/9/20 |
| EP | 0 756 062 A1 | 1/1997 | E06B/9/06 |
| FR | 506153 | 11/1919 | |
| SG | 68134 | 10/2001 | |
| WO | 95/13451 | 5/1995 | |
| WO | 98/42942 | 3/1998 | |

*Primary Examiner*—David M. Purol

(57) ABSTRACT

In one aspect, the invention provides an endless loop lock including a drive wheel adapted to be driven or not driven. An endless loop may be provided, engaging the drive wheel and adapted to be driven by the drive wheel to move a device, such as a security bar, connected to the endless loop. A guide may be provided, biased against the endless loop at a position spaced apart from the drive wheel. A lock may be provided, for engaging the endless loop to inhibit movement of the endless loop, the guide being positioned to bias the endless loop out of engagement with the lock when the endless loop is driven by the drive wheel. The lock may be actuated by a force applied to the device connected to the endless loop when the drive wheel is not driven.

18 Claims, 6 Drawing Sheets

U.S. PATENT DOCUMENTS

| | | | | | |
|---|---|---|---|---|---|
| 3,842,891 | A | | 10/1974 | Kinnroth et al. | 160/35 |
| 3,850,465 | A | | 11/1974 | Hill et al. | 292/231 |
| 3,955,661 | A | | 5/1976 | Popper et al. | 192/150 |
| 4,139,042 | A | | 2/1979 | Watanabe et al. | 160/36 |
| 4,282,920 | A | | 8/1981 | Kremm | 160/133 |
| 4,379,478 | A | | 4/1983 | Lichy | 160/35 |
| 4,662,420 | A | | 5/1987 | Hirao | 160/32 |
| 4,715,583 | A | * | 12/1987 | Grutzner | 160/344 X |
| 4,838,331 | A | | 6/1989 | Kasai | 160/36 |
| 4,953,608 | A | | 9/1990 | Larsson | 160/1 |
| 4,984,387 | A | * | 1/1991 | Wheatland | 160/188 X |
| 5,044,417 | A | | 9/1991 | Bresson | 160/310 |
| 5,065,806 | A | | 11/1991 | Kondoh | 160/36 |
| 5,139,075 | A | | 8/1992 | Desrochers | 160/310 |
| 5,172,742 | A | | 12/1992 | Iwasaki et al. | 160/36 |
| 5,211,440 | A | | 5/1993 | Cramaro | 296/98 |
| 5,222,403 | A | | 6/1993 | Angelini et al. | 74/89.21 |
| 5,373,887 | A | | 12/1994 | Glover | 160/206 |
| 5,469,905 | A | | 11/1995 | McKinney et al. | 160/35 |
| 5,957,181 | A | | 9/1999 | Cohen-Ravid et al. | 160/32 |
| 6,035,917 | A | | 3/2000 | Cohen-Ravid | 160/35 |

* cited by examiner

SECURITY BARRIER ENDLESS DRIVE LOOP LOCK

CROSS REFERENCE TO RELATED APPLICATION

This application is based on and claims benefit of U.S. Provisional Patent Application Ser. No. 60/235,911 which was filed on Sep. 28, 2000, entitled SECURITY BARRIER ENDLESS DRIVE LOOP LOCK by the same inventors.

FIELD OF THE INVENTION

The invention is in the field of mechanical devices for locking and guiding endless loops, such as an endless loop adapted for driving a security barrier.

BACKGROUND OF THE INVENTION

Security bars may be used to cover windows and doors to secure a building. For example, U.S. Pat. No. 5,957,181 (Cohen-Ravid) discloses a security bar assembly that has a plurality of bars extending across an opening. The bars have ends that join to drive chains with bar ends that cooperate with chain links to drive the bars. A drive mechanism is disclosed that moves the drive chain such that the bars slide, and therefore cover, the opening. A variety of alternative security bar installations may be used, in which an endless loop drives the security bars. In such installations, it is desirable to provide a lock that secures the security bars in place once they have been lowered.

SUMMARY OF THE INVENTION

The invention provides a locking device adaptable for use with security bar systems. The locking device may be adapted to inhibit the movement of a drive loop which is operably connected to a security bar drive mechanism. The locking device may be adapted to engage the drive loop chain in such a way that when the security bars are closed, an attempt to open the security barrier will cause the braking device to engage the chain, locking the drive chain to prevent movement of the security bars. The lock of the invention may also be adapted for a wide variety of alternative locking or braking functions, in some embodiments serving both to lock closed security bars against an opening movement while also providing a safety mechanism that locks the bars against a closing movement when an object, such as a person's arm, interferes with the closing movement of the bars (to help prevent injuries caused by movement of the bars).

In one aspect, the invention provides an endless loop lock including a drive wheel adapted to be driven or not driven. The drive wheel may have a resistance to rotation when an external force attempts to move the drive wheel at a speed that is different from the drive speed. For example, such resistance may be provided by a drive wheel that is driven by an electric motor, wherein the motor may offer a resistance to any rotational movement when it is not energized, or a resistance to rotation at any speed other than the speed at which the motor is being electrically driven. The drive wheel accordingly acts as a tensioning mechanism, and provides a means for exerting tension on the endless loop, by providing a mechanism that engages the endless loop in a manner capable of resisting movement of the endless loop. In alternative embodiments, other mechanisms may be provided as means for exerting tension on the endless loop, such as a sprocket or guide that does not serve as a drive wheel because it is not driven.

An endless loop, such as a chain, may be provided, engaging the drive wheel or alternative means for exerting tension on the endless loop. In some embodiments, the endless loop may be adapted to be driven by the drive wheel to move a device, such as a security bar, connected to the endless loop. A guide may be provided, biased against the endless loop at a position spaced apart from the drive wheel.

A lock may be provided, for engaging the endless loop to inhibit movement of the endless loop, the guide being positioned to bias the endless loop out of engagement with the lock when the endless loop is not under a locking tension, such as when the endless loop is driven by the drive wheel. The lock may for example be actuated by a force applied to a device connected to the endless loop when the drive wheel is not driven, or when the device is urged to move more quickly or more slowly than the speed conferred by the drive wheel, so that a locking tension is applied to the endless loop. The lock may accordingly be actuated when the force applied to the device urges the device connected to the endless loop to move against the resistance to rotation afforded by the drive wheel. In alternative embodiments, the resistance to movement may be provided by a clamp that engages the endless loop, a sprocket engaging the endless loop or alternative means for exerting tension on the endless loop. The force applied to the device exerts a locking tension on the endless loop, the locking tension being between the device and the drive wheel (or clamp or alternative means for exerting tension on the endless loop), so that the locking tension is exerted across the guide member The endless loop thereby engages the lock when the locking tension on the endless loop is sufficient to displace the guide (which may be detected by a detector to provide an indication that the lock has been actuated). The engagement of the endless loop by the lock may prevent movement of the endless loop, as in the case of splines on a fixed gear that engage a chain. Alternatively, the engagement of the endless loop by the lock may serve merely to inhibit the movement of the endless loop, providing a braking effect.

In some embodiments, the lock includes four elements: an endless loop, a mechanism for tensioning the loop, a device attached to the loop which may be used to exert force on the loop against the tension provided by the tensioning mechanism and a lock or locking member which is engaged when sufficient tension is applied to the loop. The loop engages the tensioning mechanism, such as a drive wheel, at a first portion of the loop, and engages the lock at a second portion of the loop. The lock is engaged when force is exerted on the loop by the device towards the tensioning mechanism, so that the second portion of the loop is subject to sufficient tension.

DETAILED DESCRIPTION

Figure 1:
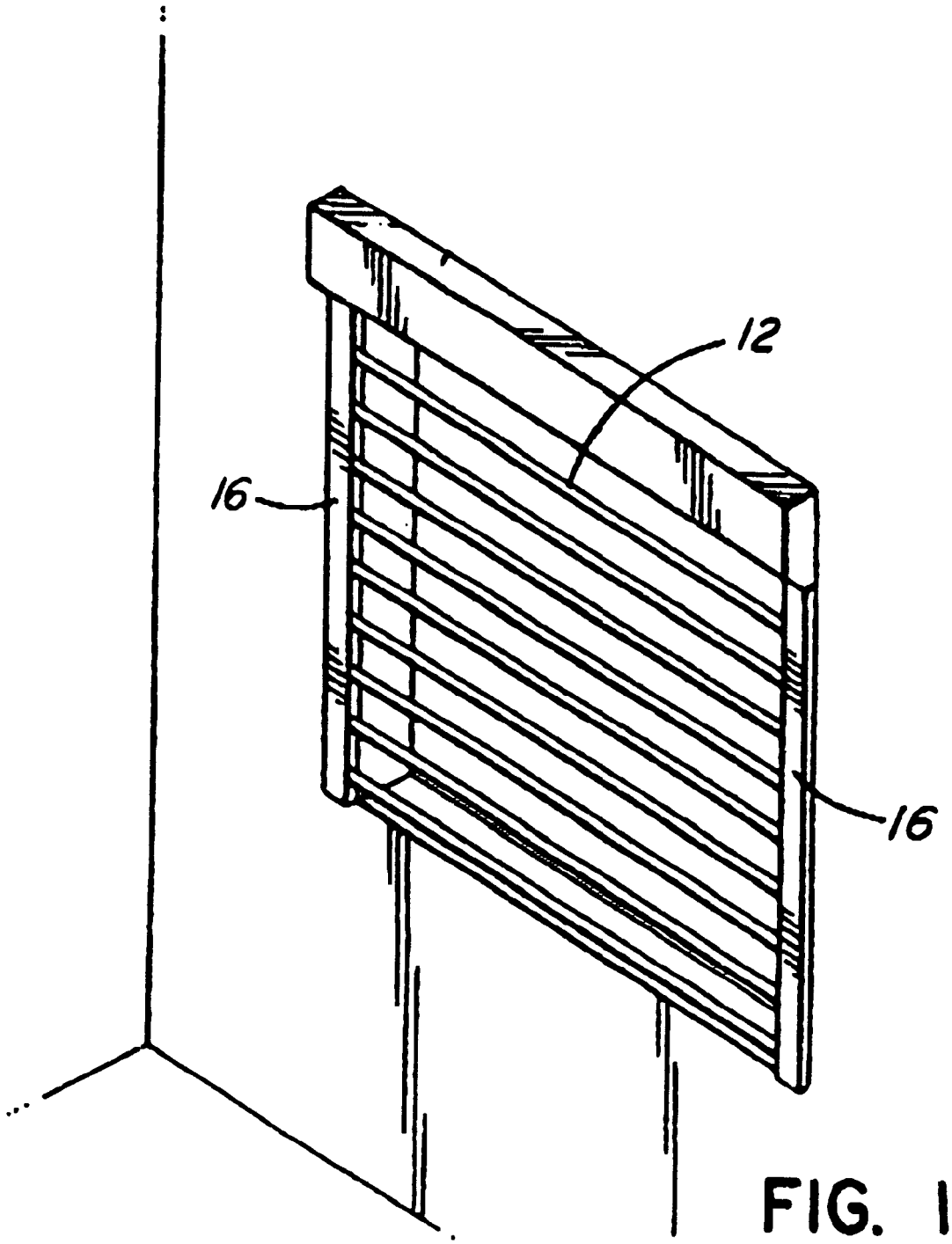
FIG. 1 is a front perspective view of a security bar installation over a window, showing the ends of the security bars running in side channels provided on the sides of the window.

An endless loop lock of the invention may be used with a security barrier placed over an opening, as shown in FIG. 1, where the security barrier comprises a plurality of security bars 12 retained in channels 16 on either side of the opening. A drive mechanism for security bars 12 may be provided in one or both of channels 16, as shown in FIGS. 2, 3 and 4.

Figure 2:
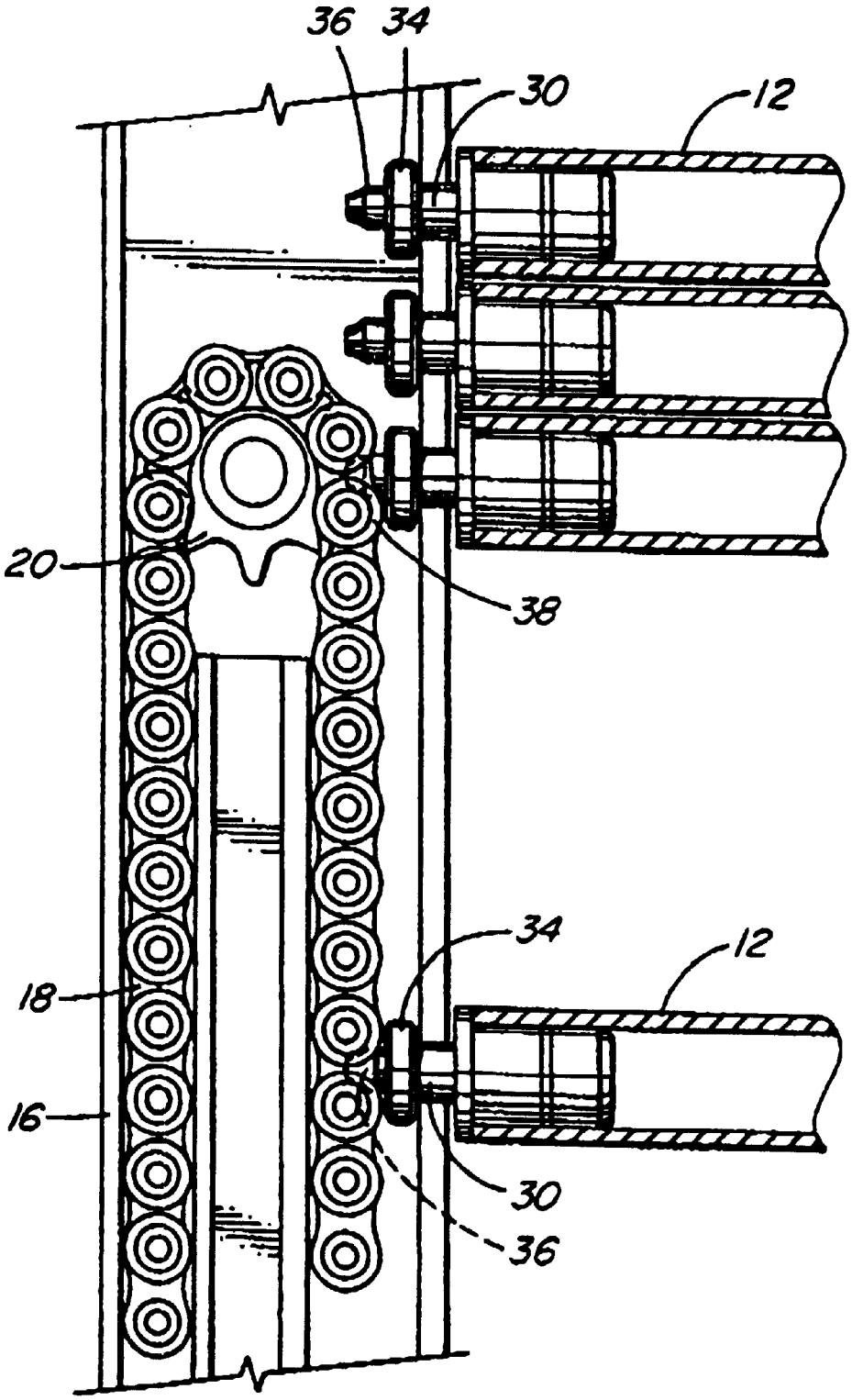
FIG. 2 is a partially broken away plan view of a top portion of a security bar side channel, showing the interior of a channel in which the ends of security bars are retained, the security bars are shown in partial cross-section, with some of the ends of the security bars connected to an endless loop chain which is driven by a drive wheel.

As shown in FIG. 2, a drive wheel 20 may be mounted for driven rotation in a top portion of channel 16. Drive wheel 20 may be adapted to be driven or not driven, so that it has two states that effect movement of endless loop 18. Drive wheel 20 may have a resistance to rotation when not driven, as for example may be the case with a drive wheel driven by an electric motor, wherein the motor may offer a resistance to movement when it is not energized or when an attempt is made to rotate the motor at a speed other than the speed at which it is driven.

Endless loop 18 may be a chain, as illustrated, engaging drive wheel 20 at a first portion of loop 18, wherein loop 18 is adapted to be driven by drive wheel 20 to move a device, such as security bar 12. In the illustrated embodiments, security bars 12 are shown connected to endless loop 18 by bar ends 36 that engage the chain links, while enlarged bar end pieces 34 interact with channel lip 32 to help to retain bars 12 in channels 16. Alternatively, the device may for example be any component driven by the endless loop, such as shutters or conveyor belt attachments such as buckets (where the endless loop is a conveyor belt).

Figure 3:
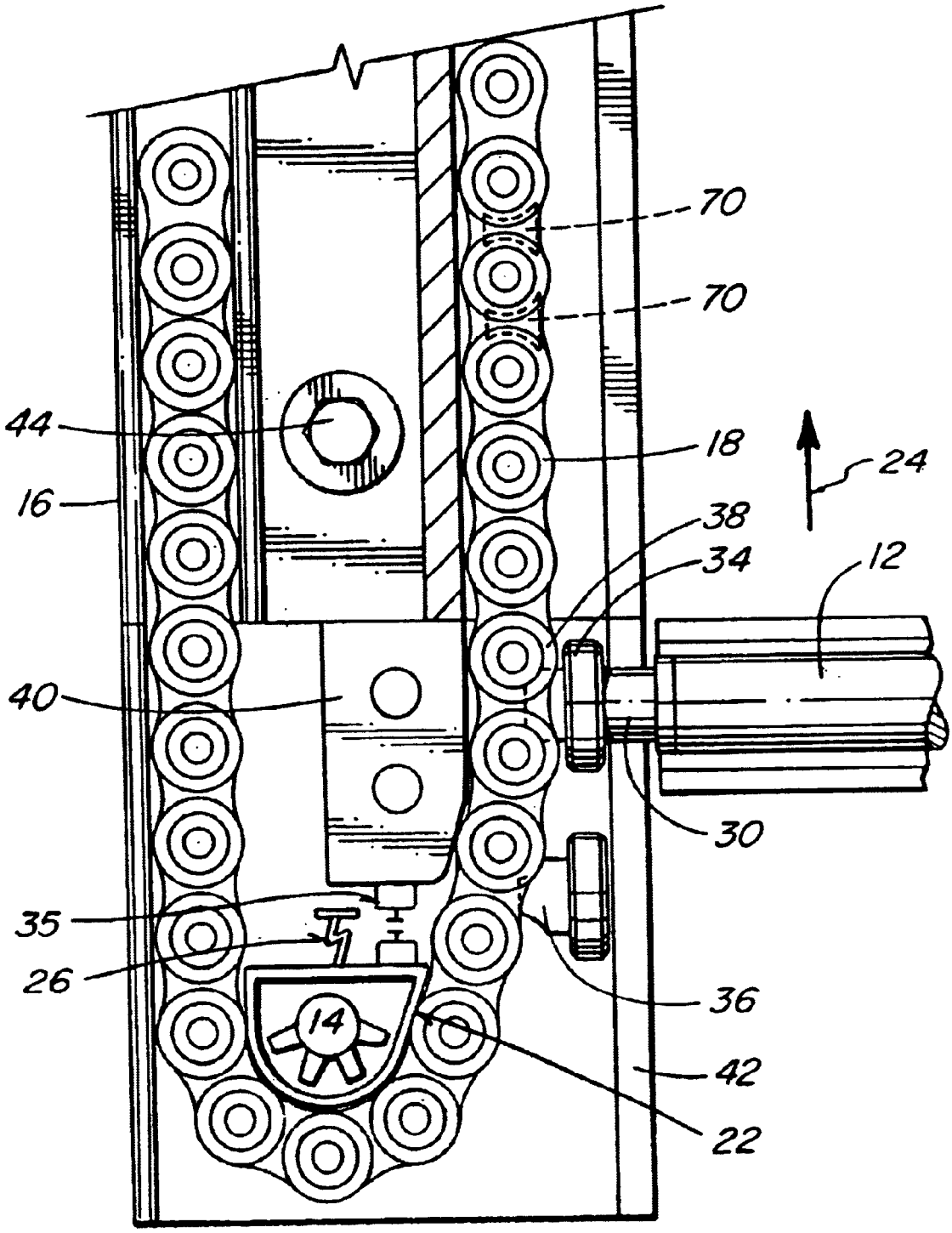
FIG. 3 is a partially broken away plan view of a bottom portion of a security bar side channel, showing the interior of the channel in which the ends of security bars are retained, with the chain that connects to the security bars shown engaging a lock wheel when a guide has been displaced by a force exerted on a security bar.
Figure 4:
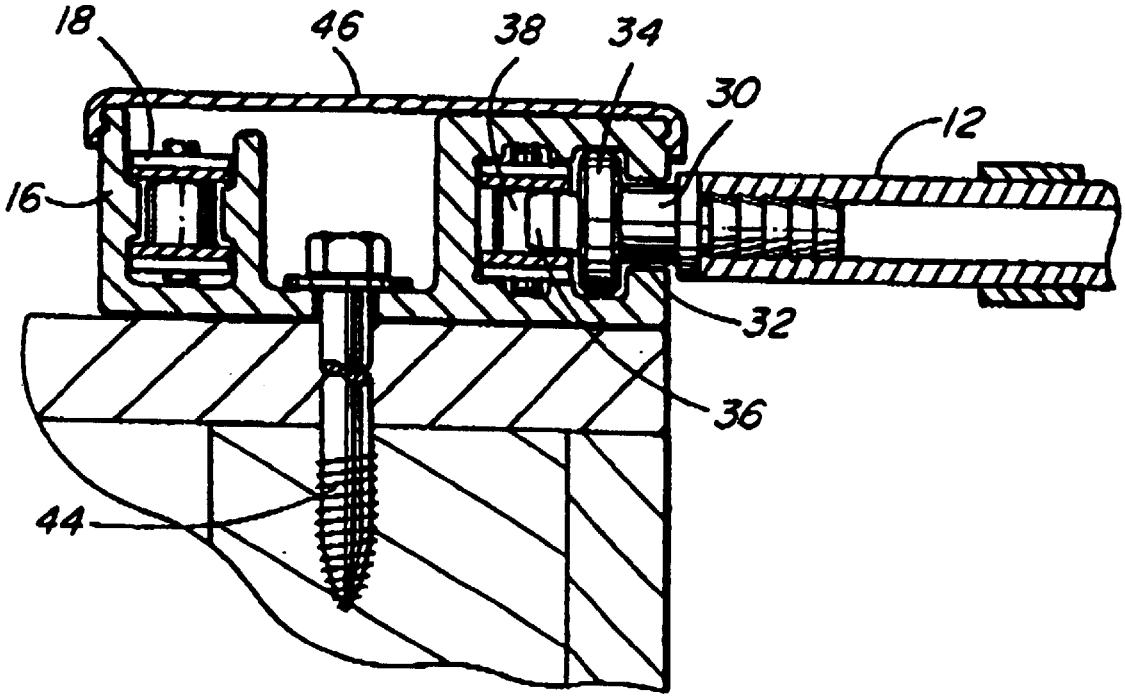
FIG. 4 is a top sectional view of a security bar side channel, showing the endless loop chain connected to a security bar, with the channel fastened to a window frame.
Figure 5:
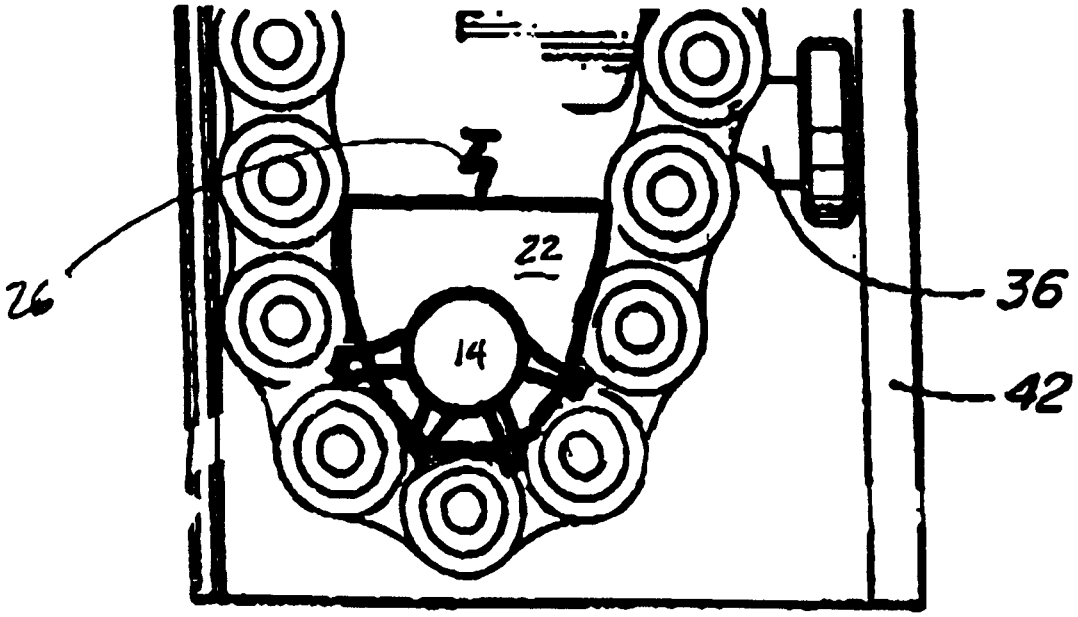
FIG. 5 is a partially broken away plan view of a bottom portion of a security bar side channel from FIG. 3, showing the guide member displaced so that the endless loop engages the braking wheel.

As shown in FIG. 3, guide 22 may be provided, biased against a second portion of endless loop 18 at a position spaced apart from drive wheel 20. As illustrated, guide 22 may be mounted to channel 16 for slidable up and down movement. Lock 14 may be provided in FIG. 3, for engaging endless loop 18, to inhibit movement of endless loop 18. Guide 22 being positioned to bias endless loop 18 out of engagement with lock 14 when endless loop 18 is driven by drive wheel 20.

Lock 14 may be actuated by a force applied to security bar 12 connected to endless loop 18 when drive wheel 20 is not driven. For example, lock 14 may be actuated when the force applied to security bar 12 urges security bar 12 upwardly, as shown in FIG. 3 by arrow 24, against the resistance to rotation afforded by drive wheel 20. In some embodiments, lock 14 will not be actuated when security bar 12 is urged downwardly, since such movement will not exert a tension on the second portion of endless loop 18 across guide 22.

As illustrated, the upward force 24 applied to security bar 12 would exert a tension on endless loop 18, the tension being between security bar 12 and drive wheel 20, and across guide 22. Endless loop 18 engages lock 14 when the tension on endless loop 18 is sufficient to displace guide 22, which may slide upwardly in the illustrated embodiment. Spring 26 may be provided to bias guide 22 downwardly, to hold endless loop 18 out of engagement with lock 14 until sufficient tension is exerted on endless loop 18. The actuation of the lock may for example be detected by a solenoid detector 35 that provides an indication that guide 22 has moved so that lock 14 has been engaged. It will be seen that the lock may also be actuated if an attempt is made to move the security bar 12 faster or slower than the speed at which the security bar 12 is driven by drive wheel 2O.

The engagement of endless loop 18 by lock 14 may prevent movement of endless loop 18, as in the illustrated embodiment showing splines on a fixed gear that engage a chain. In an alternative locking arrangement (not illustrated) the guide may be in the form of a rotatable sprocket that engages the endless loop, wherein the axle of the rotatable sprocket is slidable in a biased housing so that the rotatable sprocket is displaced into engagement with a fixed tooth when the locking tension is applied to the endless loop, so that the rotatable sprocket is immobilized by engagement with the fixed tooth to lock the endless loop against movement.

In further alternative embodiments, the guide may cooperate with the lock so that the lock is actuated when the guide is displaced by a locking tension on the endless loop. For example, movement of guide 22 may be detected electronically and a pin or lever may be actuated, for example by a solenoid, when movement of the guide is detected, so that the pin or lever locks the endless loop against movement. A guide may also be mechanically linked to a locking pin or lever, so that movement of the guide forces the locking pin or lever into position to lock the endless loop.

In alternative embodiments, the engagement of the endless loop by the lock may serve merely to inhibit the movement of the endless loop, providing a braking effect. As would be the case, for example, if endless loop 18 were a belt and lock 14 was adapted to frictionally engage the belt. It will be appreciated that many different types of endless loop 18 may be used to implement alternative aspects of the invention, including various kinds of chains and belts, and lock 14 may take the form of a wide variety of members adapted to engage endless loop 18.

It will be appreciated that in some embodiments, if an obstacle is placed in the path of security bar 12 as it is being moved downwardly by drive wheel 20, the resultant tension on endless loop 18 may be effective to displace guide 22 so that lock 14 is engaged. In which case, the locking mechanism of the invention may function as a safety catch to prevent security bars 12 from crushing an object trapped in the opening.

Figure 6:
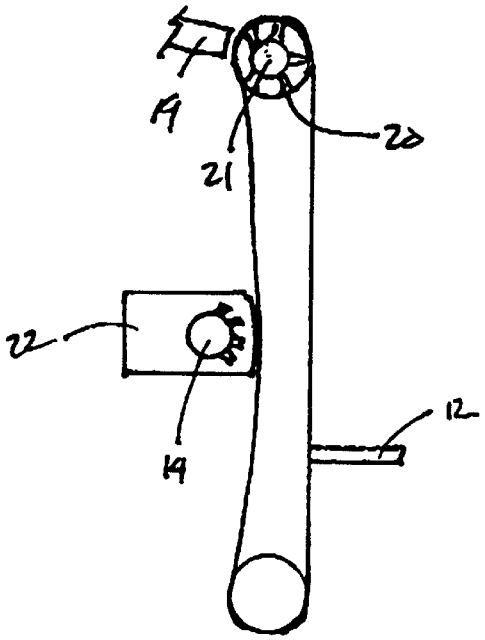
FIG. 6 is a schematic plan view of an alternative endless loop locking arrangement of the invention, showing the guide biased against the inside of the endless loop to hold the endless loop out of engagement with the lock.
Figure 7:
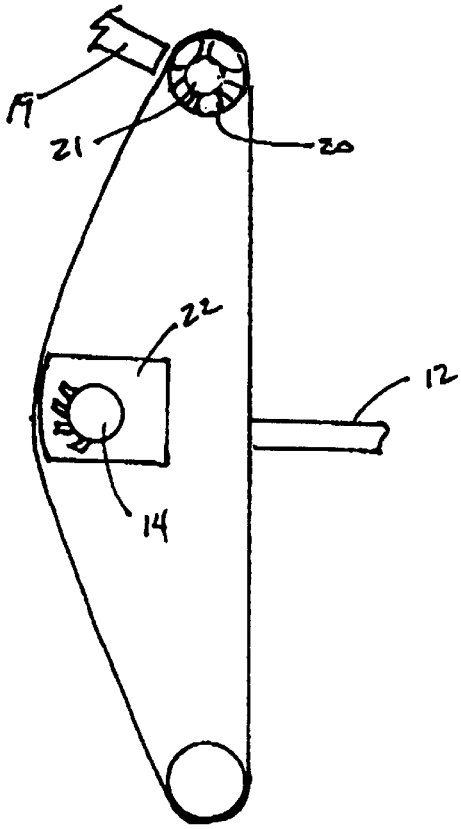
FIG. 7 is a schematic plan view of an alternative endless loop locking arrangement of the invention, showing the guide biased against the outside of the endless loop to hold the endless loop out of engagement with the lock.

Although various embodiments of the invention are disclosed herein, many adaptations and modifications may be made within the scope of the invention in accordance with the common general knowledge of those skilled in this art. For example FIGS. 6 and 7 schematically illustrate alternative arrangements of guide 22, lock 14, endless loop 18, drive wheel 20 and security bar 12, which may be utilized for alternative installations of the invention. It is also to be understood that the description of drive wheel 20 as being driven or not driven is a functional term that merely indicates that there are two states in which drive wheel 20 may provide different effects on endless loop 18. In the driven state, drive wheel 20 is effective to move a device connected to endless loop 18 in a desired direction. Whereas in the state in which it is not driven, drive wheel 20 will resist rotation to the extent that it will effectively counteract a force applied to the device connected to the endless loop, so that the lock is engaged. In alternative embodiments, the resistance to movement may be provided by a clamp 19 or sprocket 21 that engages endless loop 18. When applied, clamp 19 may frictionally engage the endless loop 18.

Contemplated modifications of the invention include the substitution of known equivalents for any aspect of the invention in order to achieve the same result in substantially the same way. In the following claims, the word "comprising" is used as an open-ended term, substantially equivalent to the phrase "including, but not limited to".

What is claimed is:

1. An endless loop lock comprising:

(a) a drive wheel adapted to be driven at a drive speed, wherein the drive wheel has a resistance to rotation at a speed different from the drive speed;

(b) an endless loop engaging the drive wheel at a first portion on the endless loop, wherein the endless loop is adapted to be driven by the drive wheel to move a device connected to the endless loop;

(c) a guide biased against a second portion of the endless loop at a position spaced apart from the drive wheel;

(d) a lock for engaging the endless loop to inhibit movement of the endless loop, the guide being positioned to bias the endless loop out of engagement with the lock when the endless loop is driven by the drive wheel;

(e) wherein the lock may be actuated by a force on the device connected to the endless loop, when the force urges the endless loop and the device connected to the endless loop to move against the resistance to rotation provided by the drive wheel so as to exert a tension on the second portion of the endless loop, and the tension on the second portion of the endless loop is sufficient to displace the guide so that the endless loop engages the lock.

2. The endless loop lock of claim 1, wherein the device connected to the endless loop is a security bar.

3. The endless loop lock of claim 1, wherein the endless loop is a chain.

4. The endless loop lock of claim 2, wherein the endless loop is a chain.

5. The endless loop lock of claim 1, wherein the drive wheel is powered by an electric motor.

6. The endless loop lock of claim 2, wherein the drive wheel is powered by an electric motor.

7. The endless loop lock of claim 3, wherein the drive wheel is powered by an electric motor.

8. The endless loop lock of claim 1 further comprising a clamp for clamping the endless loop, wherein the actuation of the clamp provides the resistance to rotation of the drive wheel.

9. The endless loop lock of claim 7 further comprising a clamp for clamping the endless loop, wherein the actuation of the clamp provides the resistance to rotation of the drive wheel.

10. The endless loop lock of claim 1 further comprising a detector for detecting the displacement of the guide.

11. An endless loop lock comprising:

(a) a means for exerting tension on an endless loop, wherein the means for exerting tension cooperates with the endless loop so that tension may be applied to the endless loop against a resistance provided by the means for exerting tension;

(b) a guide biased against the endless loop at a position spaced apart from the means for exerting tension on the endless loop;

(c) a lock for engaging the endless loop to inhibit movement of the endless loop, the guide being positioned to bias the endless loop out of engagement with the lock when the endless loop is not under a locking tension;

(d) wherein the lock may be actuated by the application of a force on the endless loop, the lock being actuated when the force urges the endless loop to move against the resistance provided by the means for exerting tension on the endless loop so that the locking tension is applied to the endless loop across the guide, wherein the locking tension is sufficient to displace the guide so that the endless loop engages the lock.

12. The endless loop lock of claim 11, wherein a security bar is connected to the endless loop.

13. The endless loop lock of claim 11, wherein the endless loop is a chain.

14. The endless loop lock of claim 12, wherein the endless loop is a chain.

15. The endless loop lock of claim 11 wherein the means for exerting tension on the endless loop is a clamp for clamping the endless loop.

16. The endless loop lock of claim 11 further comprising a detector for detecting the displacement of the guide.

17. An endless loop lock comprising:

(a) a tensioning mechanism for exerting tension on an endless loop, wherein the tensioning mechanism cooperates with the endless loop so that tension may be applied to the endless loop against a resistance provided by the tensioning mechanism;

(b) a guide biased against the endless loop at a position spaced apart from the tensioning mechanism;

(c) a lock for engaging the endless loop to inhibit movement of the endless loop, the guide being positioned to bias the endless loop out of engagement with the lock when the endless loop is not under a locking tension;

(d) wherein the lock may be actuated by the application of a force on the endless loop, the lock being actuated when the force urges the endless loop to move against the resistance provided by the tensioning mechanism so that the locking tension is applied to the endless loop across the guide, wherein the locking tension is sufficient to displace the guide so that the endless loop engages the lock.

18. An endless loop lock comprising:

(a) a tensioning mechanism for exerting tension on an endless loop, wherein the tensioning mechanism cooperates with the endless loop so that tension may be applied to the endless loop against a resistance provided by the tensioning mechanism;

(b) a guide biased against the endless loop at a position spaced apart from the tensioning mechanism;

(c) a lock for engaging the endless loop to inhibit movement of the endless loop, the guide cooperating with the lock so that the lock is actuated when the guide is displaced by a locking tension on the endless loop;

(d) wherein the lock may be actuated by the application of a force on the endless loop, the lock being actuated when the force urges the endless loop to move against the resistance provided by the tensioning mechanism so that the locking tension is applied to the endless loop across the guide, wherein the locking tension is sufficient to displace the guide so that the endless loop engages the lock.

* * * * *